US005324368A

United States Patent [19]

Masumoto et al.

[11] Patent Number: 5,324,368

[45] Date of Patent: Jun. 28, 1994

[54] FORMING PROCESS OF AMORPHOUS ALLOY MATERIAL

[75] Inventors: Tsuyoshi Masumoto, 3-8-22, Kamisugi, Aoba-ku; Akihisa Inoue, 11-806, Kawauchijutaku, Mubanchi, Kawauchi, Aoba-ku, both of Sendai-shi, Miyagi; Nobuyuki Nishiyama, Sendai; Hiroyuki Horimura, Fujimi; Toshisuke Shibata, Sendai, all of Japan

[73] Assignees: Tsuyoshi Masumoto; Akihisa Inoue, both of Miyagi; Yoshida Kogyo K.K., Tokyo, all of Japan

[21] Appl. No.: 885,480

[22] Filed: May 19, 1992

[30] Foreign Application Priority Data

May 31, 1991 [JP] Japan ..... 3-129670

[51] Int. Cl.[5] ..... C22C 45/00

[52] U.S. Cl. ..... 148/561; 148/403; 29/421.1

[58] Field of Search ..... 148/561, 403; 72/57, 72/60; 29/421.1

[56] References Cited

U.S. PATENT DOCUMENTS 4,289,009 9/1981 Festag et al. ..... 72/60
4,472,955 9/1984 Nakamura et al. ..... 72/57
4,990,198 2/1991 Masumoto et al. ..... 148/403
5,032,196 7/1991 Masumoto et al. ..... 148/403

FOREIGN PATENT DOCUMENTS 61-238423 10/1986 Japan ..... 72/60
2236325 4/1991 United Kingdom .

*Primary Examiner*—George Wyszomierski
*Attorney, Agent, or Firm*—Flynn, Thiel, Boutell & Tanis

[57] ABSTRACT

Disclosed herein is a process for forming an amorphous alloy material capable of showing glass transition, which comprises holding the material between frames arranged in combination; and heating the material at a temperature between its glass transition temperature (Tg) and its crystallization temperature (Tx) and, at the same time, producing a pressure difference between opposite sides of the material, whereby the material is brought into close contact against a forming mold disposed on one side of the material. As an alternative, the forming mold is brought into close contact against the amorphous material in a direction opposite to the pressing direction for the amorphous material. By the above processes, precision-formed products of amorphous alloys can be manufactured and supplied at low cost. These formed amorphous alloy products can be used as mechanical structure parts and components of high strength and high corrosion resistance, various strength members, electronic parts, arts and crafts, original printing plates, or the like.

16 Claims, 4 Drawing Sheets

FORMING PROCESS OF AMORPHOUS ALLOY MATERIAL

BACKGROUND OF THE INVENTION

1. Field of the Invention

The present invention relates to a process of forming an amorphous alloy material having excellent strength and corrosion resistance.

2. Description of the Prior Art

Since a high cooling rate is required for the production of amorphous alloys in a conventional manner, liquid quenching, gas atomization or the like has been used to obtain amorphous alloys such as iron-based or nickel-based amorphous alloys in the form of ribbons or powder. Further, wire-like amorphous alloys have also been obtained by in-rotating-water spinning or the like. Making use of their characteristic properties, they have found wide-spread commercial utility as magnetic materials, high-strength materials, corrosion-resistant materials, etc.

To form these alloys into a plate-like configuration, it is however necessary to use extrusion, rolling and the like forming processes, either singly or in combination. The materials described above however have high strength so that it is difficult to apply these forming processes. Plate-like amorphous materials, as blanks for forming work, cannot be obtained with ease. It is therefore the current situation that there is practically no product formed from a plate-like amorphous material. On the other hand, a certain type of crystalline materials shows superplasticity when their grain sizes are precisely controlled. Forming processes making use of this phenomenon are applied to plate-like materials, whereby products of a complex configuration are manufactured. This superplastic working is however accompanied by the drawback that the working speed is very low and complex steps are required for the control of the grain size.

As has been described above, conventional amorphous alloy materials can be formed by direct quenching such as liquid quenching, as atomization or in-rotating-water spinning. It is difficult, however, to directly produce plate-like amorphous materials from such alloy materials and by such processes.

From alloys capable of showing glass transition, on the other hand, it is possible to produce plate-like amorphous materials by applying extrusion, rolling and the like, either singly or in combination, to amorphous alloys, which have been obtained in the form of a ribbon or powder, as, inter alia, in Japanese Patent Laid-Open Nos. 3-10041, 3-36243 and 3-158446. Although production processes relying upon one or more of these working techniques are excellent, the working requires many steps, leading to the existence of room for improvements, from an economical standpoint.

The present inventors have already discovered that the alloys disclosed in the above applications, the alloys being capable of showing glass transition, can be formed into amorphous bulk materials by direct casting or the like. An application for patent has already been filed based on this finding (Patent Application No. 2-49491). It has now been found that a plate-like formed product can be obtained economically and with ease by forming such a bulk material (plate material) in a temperature range of from glass transition temperature (Tg) to crystallization temperature (Tx), leading to the completion of this invention.

SUMMARY OF THE INVENTION

In one aspect of this invention, there is thus provided a process for forming an amorphous alloy material capable of showing glass transition, the method comprising: holding the material between frames arranged in combination; and heating the material at a temperature between its glass transition temperature (Tg) and its crystallization temperature (Tx) and, at the same time, producing a pressure difference between opposite sides of the material, whereby the material is brought into close contact against a forming mold disposed on one side of the material.

Another aspect of the present invention provides a process for forming an amorphous alloy material capable of showing glass transition, the method comprising: holding the material between frames arranged in combination; and heating the material at a temperature between its glass transition temperature (Tg) and its crystallization temperature (Tx) and, at the same time, producing a pressure difference between opposite sides of the material, whereby a forming mold is pressed against the material.

In both of the above processes, it is preferable to part the thus-formed amorphous alloy material after forcedly cooling the same to Tg or lower.

The amorphous material capable of showing glass transition, which is useful in the practice of such forming processes, can be selected from those represented by any one of the following general formulas (I) to (III):

General formula (I):

$Al_{100-(a+b)}M^1{}_aX^1{}_b$ wherein $M^1$ is at least one element selected from the group consisting of Ti, V, Cr, Mn, Fe, Co, Ni, Cu, Zr, Nb, Mo, Hf, Ta and W; $X^1$ is at least one element selected from the group consisting of Y, La, Ce, Nd, Sm and Gd or Mm (a mischmetal); a and b are 55% or less and 30–90% in terms of atom percent, respectively, and (a+b) is at least 50% in terms of atom percent;

General formula (II):

$X^2{}_mM^2{}_nAl_p$ wherein $X^2$ is at least one element selected from the group consisting of Zr and Hf; $M^2$ is at least one element selected from the group consisting of Ni, Cu, Fe, Co and Mn; and m, n and p are 25–85%, 5–70% and 35% or less in terms of atom percent, respectively; and General formula (III):

$Mg_xM^3{}_yLn_z$ or $Mg_xM^3{}_yX^2{}_qLn_z$ wherein $M^3$ is at least one element selected from the group consisting of Cu, Ni, Sn and Zn; $X^2$ is at least one element selected from the group consisting of Al, Si and Ca; Ln is at least one element selected from the group consisting of Y, La, Ce, Nd, Sm and Gd or Mm; and x, y, z and q are 40–90%, 4–35%, 4–25% and 2–25% in terms of atom percent, respectively.

DETAILED DESCRIPTION OF THE PREFERRED EMBODIMENTS

Figure 1:
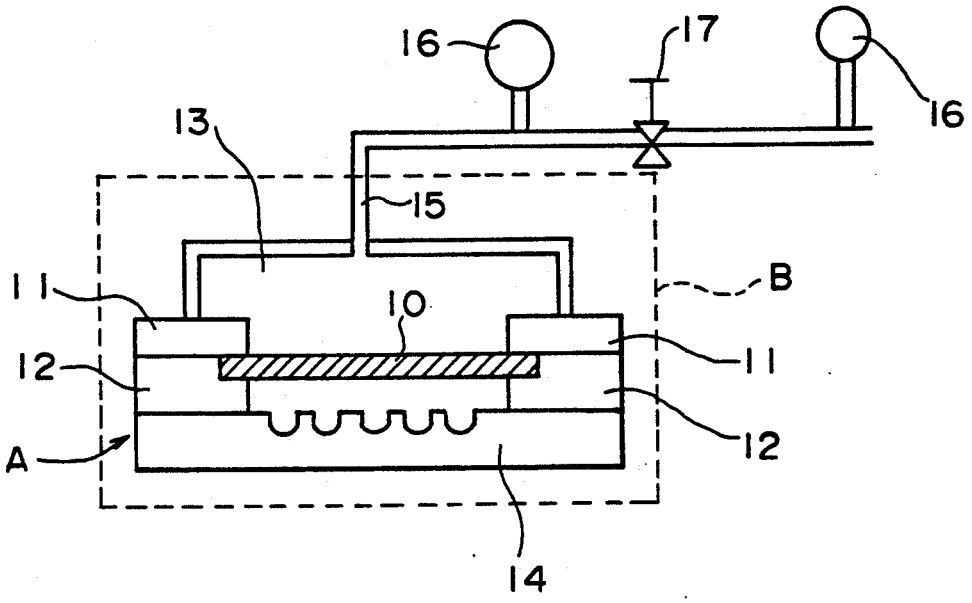
FIG. 1 is a schematic illustration of an embodiment of the present invention.

These amorphous materials can each be obtained in the form of an amorphous, single-phase, bulk material capable of showing glass transition when its melt is solidified at a cooling rate of $10^2$ K/sec or greater. It is generally known that an alloy capable of showing glass transition forms a supercooled liquid in its glass transition temperature range and can be deformed to significant extent with ease under very small stress (normally, 10 MPa or less). (Before the amorphous alloys disclosed in the above patent applications came to knowledge, there had been no alloy capable of showing glass transition among practical amorphous alloys.)

As a result of a further extensive investigation, the present inventors have also found that, while an amorphous material capable of showing glass transition is in the form of a supercooled liquid, it can be instantaneously subjected to forming operations and can also be fed to every corner of a forming mold, or even to a portion having a complex configuration of small dimensions, and a formed product having uniform thickness distribution can be furnished owing to its large fluidity.

According to the present invention, various amorphous alloy materials obtained by continuous or discontinuous casting are each heated to a glass transition temperature range specific to the material and, then, formed by using its properties as a supercooled liquid in the temperature range, whereby plate-like, formed products can be obtained.

Glass transition temperatures and glass transition temperature ranges vary from one alloy to another. Even in the glass transition temperature range, crystallization proceeds when the alloy is held for a long time in the temperature range. The heating temperature of a material to be worked and the holding time at that working temperature should be controlled depending on the material. According to the results of an experiment conducted by the present inventors, it is generally necessary to set the heating temperature above Tg but below Tx and the permissible holding time in a range not exceeding the time equivalent to (Tx−Tg) except for the substitution of minutes for its unit (hereinafter called "ΔT"). Preferably recommended are a temperature higher than Tg but lower than $(Tg+Tx)\times\frac{2}{3}$ with a temperature control width of $\pm(0.3\times\Delta T)$ (with the proviso that the temperature must be within the range of from Tg to Tx) and a holding time within $\Delta T\times\frac{1}{3}$ (unit: minutes). Mg-based and rare-earth-based alloys have a very large ΔT so that the permissible holding time can be as long as up to about 30 minutes. Although Zr-based alloys have a ΔT of a similar width, their heating temperature and time do not follow these general conditions and are required to be lower and shorter.

The heating rate up to the glass transition range may preferably be 10 K/min or greater. Regarding the cooling rate after the forming, it is desired to promptly reach a temperature not higher than (Tg−50) K in order to avoid embrittlement due to structural relaxation below Tg. Although it is generally sufficient to cool the formed material in air subsequent to its parting from the forming mold in the case of the alloy system described above, other suitable cooling means can be adopted depending on the alloy or on the forming manner and objective of the forming. Basically, the temperature of the forming mold may be between the Tg and Tx of the material to be formed. However, it is generally maintained at the same temperature as the forming temperature. Heating of the clamping frames is not essential.

Air or any inert gas is suitable as the pressurizing fluid. Preheating is not required in the case of a gas because its specific heat is small in general. Preheating is, however, preferred when a gas is fed in a large volume or precise temperature control is required. A preheated oil can also used when precise temperature control is required. As the preheating temperature, the forming temperature is suited in principle.

The strain rate upon forming can be $10^{-5}$–$10^2$/sec. The deformation stress at such a strain rate varies in a range of from 1 MPa to 60 MPa depending on the alloy, temperature and strain rate. Forming conditions are controlled in accordance with the stability of the supercooled liquid of the amorphous alloy material and the shape and quality of the product. Production of an amorphous material as an intermediate blank for forming can be conducted, for example, by direct pouring into an iron or copper-made mold or the like or by punching of a continuous strip produced continuously by a moving mold constructed of a pair of copper-made rotating wheels or a copper-made rotating wheel and a stainless-steel-made belt. In the case of the alloys described above, intermediate blanks of 0.5–10 mm in thickness can be obtained as amorphous plate materials. To obtain a cooling rate of $10^2$ K/sec or greater, the temperature of the molten metal to be cast is desirably lower than [the melting point (Tm)+200 K]. The desired temperature of the forming mold should sufficiently be lower than Tg (e.g., Tg−100 K).

To heat the plate material to its glass transition temperature range, a conventionally-known heating furnace, oil bath or the like is effective. It is the general practice that the forming mold and the like are heated to an appropriate temperature in advance.

The forming is a process which is, in principle, similar to bulging of a metal material, blow molding as applied to a resin material or other like processes. The material to be worked is deformed by a pressure of a fluid such as a gas, the pressure being applied in one direction, so that the material is brought into close contact against a mold conforming in profile with the target product and is hence formed. It is the features of the present invention that the forming can be conducted at a wide range of forming speeds equivalent to $10^{-5}$–$10^2$/sec in terms of strain rate and at a low pressure around 0.1 MPa in terms of the pressure of the fluid and, moreover, that a formed, amorphous alloy product can be obtained. Since an amorphous alloy heated to its glass transition temperature range has properties as a supercooled liquid, the profile of a forming mold is faithfully reproduced (transferred) on the resulting, formed product even if the forming mold has a very complex profile of small dimensions. In addition, different from working of general metal materials, it is unnecessary to take into account "spring back" which would otherwise be caused by elastic deformation, so that the formed product is extremely good in dimensional stability. It is here that the forming according to the present invention is considerably different from the conventional bulging of metal materials.

A plate material which has been deformed and bulged by the pressure of a fluid is brought into contact with a convex or concave, forming mold and is hence formed in accordance with the profile of the forming mold. The thickness of the plate material decreases as the swell becomes greater. In the case of a product having a complex shape or a shape requiring a large swell (intense working), a substantial difference occurs in the distribution of wall thickness between a portion brought into close contact against the forming mold in a relatively early stage and a portion brought into contact against the forming mold in a later stage. In a worst case, local rupture may takes place so that the forming may become no longer feasible or a defect may occur in the material. To avoid this inconvenience, it may be necessary in some instances to conduct the bulging and deformation in such a way that the material is allowed to undergo free swelling without contact to the forming mold (i.e., is formed into a semi-spherical or like shape), thereby making uniform the distribution of its thickness and the forming mold is then pressed against the swollen portion to bring the material into close contact with the forming mold, thereby forming the material. According to this process, it is possible to make the distribution of the wall thickness of a material uniform and, at the same time, prevent the occurrence of a rupture or defect in the material, even if the material has been subjected to intense working.

Because the forming process can attain sufficient deformation (forming) with a gas pressure as low as 0.1 MPa or so as described above, it is readily contemplated that forming is feasible by evacuating the space on one side and making use of the resulting difference in pressure from the atmosphere.

As has been described above, the present invention can easily and economically form an amorphous plate material by only a single piece of male or female, forming mold.

The present invention will hereinafter be described specifically on the basis of the following examples.

EXAMPLE 1

Figure 6:
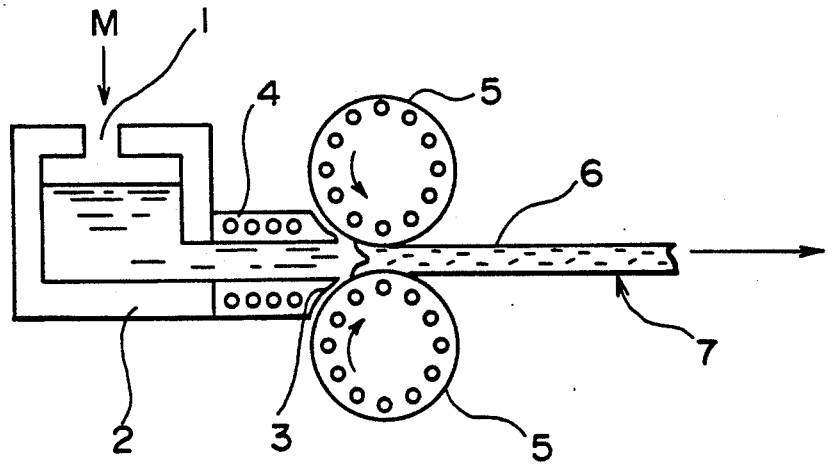
FIG. 6 is a schematic illustration of one example of production of a forming blank.

An alloy melt having an alloy composition of $La_{5.5}Al_{25}Ni_{20}$ (atom %) was prepared in a high-frequency melting furnace. Through a sprue 1 of a casting apparatus illustrated in FIG. 6, the melt designated at letter M was poured into a melt feed channel 2. Through the melt feed channel 2, the melt M was pressurized at a predetermined constant pressure toward a gate 3 by an unillustrated pressurizing pump. The melt M was cooled to a predetermined temperature i a first stage quenching zone (temperature control portion) 4 provided in the melt feed channel 2, whereby the melt M so cooled was delivered under pressure into a solidification zone 6 formed by a pair of water-cooled rolls 5, 5 and was continuously solidified at a cooling rate of about $10^2$ K/sec to obtain a continuously cast plate material 7 of 60 mm in width and 5 mm in thickness. From this plate material 7, disks of 55 mm in diameter were punched out as forming blanks. One of the blanks 10 was set on a forming apparatus A shown in FIG. 1. Namely, the blank 10 was held at a peripheral edge portion thereof between clamping frames 11 and 12. A closed space 13 is provided on the side of the clamping frame 11 and a forming mold 14 is provided on the side of the clamping frame 12. A pressurizing fluid feed line 15 opens at the space 13. The pressurizing fluid feed line 15 is provided with a pressure gauge 16 and a pressure control valve 17. The apparatus of the construction as described was heated in its entirety in an oil bath B whose temperature was controlled at 473±1 K. After the temperature was stabilized, the pressure control valve 17 of the pressurizing fluid feed line 15 connected to the space 13 was opened so that nitrogen gas controlled at 0.1 MPa in advance was fed to the space 13 to conduct forming. The forming time was within 2 seconds. As a result, a formed product faithfully reproducing the profile of the forming mold and having an average wall thickness of 1.5 mm was obtained.

The cast plate material obtained as described above was investigated by differential scanning calorimetry (DSC; heating rate: 40 K/min). As a result, the plate material showed distinct glass transition with a glass transition temperature of 470.3 K and a crystallization temperature of 553.6 K. To determine whether the material was amorphous both before and after the forming, the material was also analyzed by ordinary X-ray diffraction. As a result, halo patterns inherent to an amorphous structure were shown both before and after the forming, thereby demonstrating that the material remained amorphous even after its forming.

Hardness was also investigated at room temperature. The cast plate had a hardness of Hv 227 (DPN) before the forming and a hardness of Hv 231 (DPN) after the forming, thereby demonstrating that it had excellent mechanical strength both before and after the forming.

EXAMPLE 2

Figure 7:
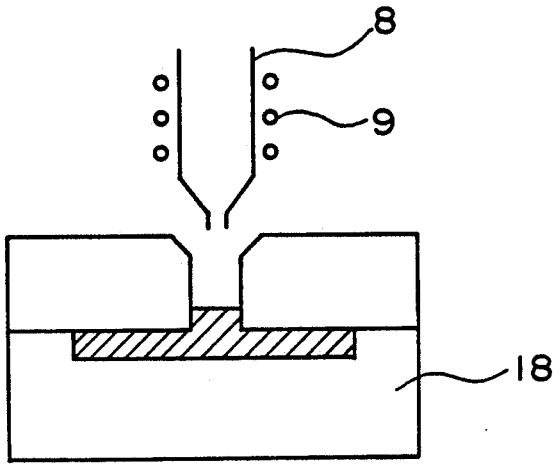
FIG. 7 is a schematic illustration of another example of production of a forming blank.

An alloy having an alloy composition of $Zr_{70}Ni_{1.5}Al_{15}$ (atom %) was placed in a quartz crucible 8 depicted in FIG. 7. After the alloy was subjected to high-frequency heating and melting by a high-frequency heating coil 9, the resultant melt was injected into a copper-made mold 18 under a back pressure of argon gas so that a plate material of 55 mm in diameter and 3 mm in thickness was obtained. The plate material was formed by the forming apparatus of Example 1, whereby a similar formed product (thickness: 1.5 mm) was successfully obtained. However, the heating to the forming temperature was performed using an electrical resistance heating furnace instead of the oil bath, and the temperature and gas pressure were set at 680±5 K and 0.3 MPa, respectively. As in Example 1, the formed product so obtained faithfully reflected the profile of the forming mold, was amorphous, showed high room-temperature hardness, i.e., Hv 435 (DPN) and had high strength.

EXAMPLE 3

Figure 2:
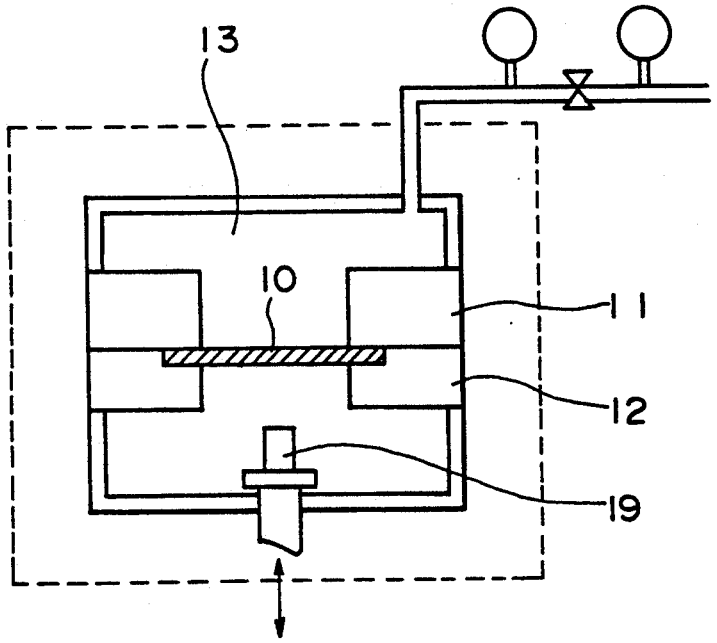
FIG. 2 is a schematic illustration of another embodiment of the present invention.
Figure 3:
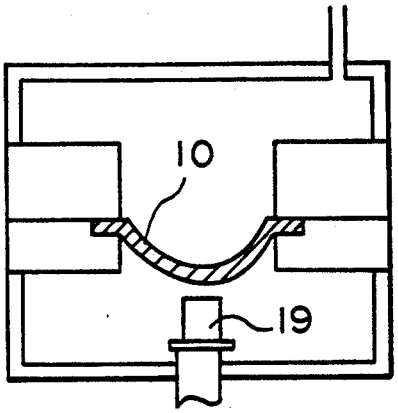
FIG. 3 is a schematic illustration of the embodiment of FIG. 2, showing an intermediate stage.
Figure 4:
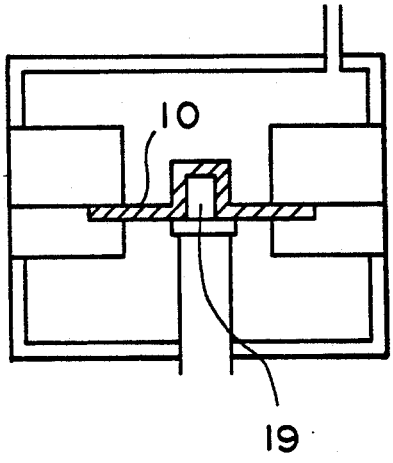
FIG. 4 is a schematic illustration of the embodiment of FIG. 2, illustrating a final stage.

Using the casting apparatus of Example 2, a similar cast plate material was obtained from an alloy having an alloy composition of $Mg_{70}Cu_{10}La20$ (atom %). That plate material was set on a forming apparatus which is depicted in FIG. 2 and is similar to the forming apparatus of Example 1 except for a modification such that a forming mold can be moved up and down. Namely, the blank 10 was held between the clamping frames 11 and 12, and the space 13 is provided on the side of the clamping frame 11 whereas the forming mold designated at numeral 19 was provided on the side of the clamping frame 12. The forming mold 19 is in the form of a cylinder having a diameter of 15 mm and a length of 30 mm. The temperature of the oil bath B and the pressure of the pressurizing gas were, however, set at 440±1 K and 0.1 MPa, respectively. The blank 10 was first heated with the forming mold 19 in a lowered position. After the temperature of the blank 10 was stabilized, the gas was fed to swell the blank 10 substantially into a semi-spherical shape as illustrated in FIG. 3. The forming mold 19 was then raised as illustrated in FIG. 4, whereby the blank 10 and the forming mold 19 were brought into close contact to each other and the gas pressure was then increased to 0.2 MPa to keep the blank 10 and the forming mold 19 in still closer contact. The formed product so obtained was in the form of a cylinder closed at one end and amorphous, and its hardness at room temperature was Hv 205 (DPN). The distribution of the wall thickness of the formed product was investigated. The wall thickness was found to be within a range of ±0.05 mm over the entire range.

EXAMPLE 4

Figure 5:
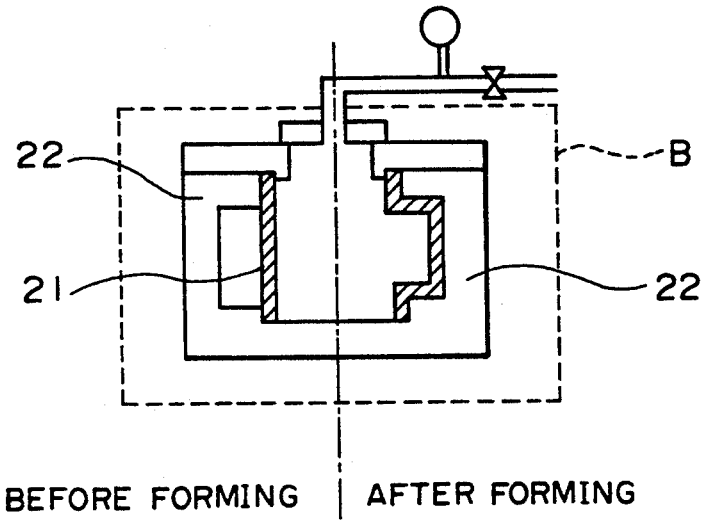
FIG. 5 is a schematic illustration of a further embodiment of the present invention.
Figure 8:
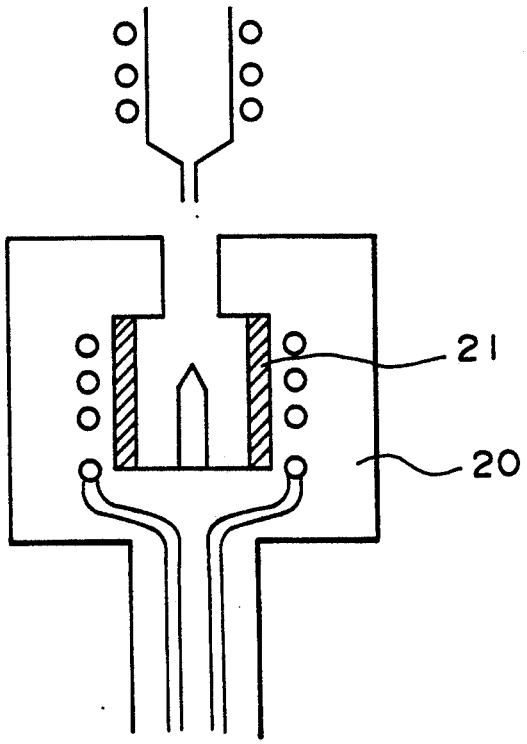
FIG. 8 is a schematic illustration of a further example of production of a forming blank.

An alloy melt of the same composition as in Example 3 was cast in a copper-made casting mold 20 shown in FIG. 8 and rotating at 1,500 rpm, thereby obtaining a cylindrical, amorphous forming material 21 of 20 mm in outer diameter, 5 mm in inner diameter and 30 mm in length. The blank was set on a forming apparatus, which is shown in FIG. 5 and had a cylindrical, split forming mold 22. The temperature of the oil bath B and the pressure of the pressurizing gas were set at 440±1 K and 0.1 MPa, respectively. After the temperature was raised and stabilized, a gas was fed to the interior of the forming blank so that the forming blank was readily deformed into the profile of the forming mold. The formed product so obtained was amorphous and its properties were substantially the same as in example 3. In FIG. 5, the left-hand half relative to the center line indicates the state of the blank before the forming whereas the right-hand half shows the stage of the blank after the forming.

As has been demonstrated above, it is understood that the process of this invention is excellent as a process for economically providing a formed product capable of showing glass transition. This process can be applied not only to the alloy systems described in the examples but also to other alloy systems insofar as they are amorphous alloys capable of showing glass transition.

Precision-formed products of amorphous alloys can be manufactured and supplied at low cost by the present invention. These formed, amorphous alloy products can be used as mechanical structural parts and components of high strength and high corrosion resistance as well as various strength members.. As very precise transfer of a profile is feasible, they can also be used as electronic parts, arts and crafts (original plates for reliefs and lithographs), original printing plates or the like. By parting a formed product from a forming mold after subjecting the formed material to forced cooling to a temperature of not higher than Tg, the formed product can be taken out while maintaining the temperature of the forming mold at a constant temperature (a preheating temperature of Tg or higher) so that the production cycle can be shortened to improve the efficiency of production.

We claim:

1. A process for forming an amorphous alloy material capable of showing glass transition, said process comprising the steps of holding the material between frames arranged in combination and holding the material at a temperature between its glass transition temperature (Tg) and its crystallization temperature (Tx) while, at the same time, producing a pressure difference between opposite sides of the material, whereby the material is brought into close contact against a forming mold disposed on one side of the material, the strain rate during forming being from $10^{-5}$ to $10^{2}$/sec and the deformation stress being from 1 MPa to 60 MPa.

2. The process of claim 1, wherein a closed space for a pressurizing fluid is provided on the other side of the material and the pressurizing fluid is fed to the closed space to form the material.

3. The process of claim 1, wherein after the material is brought into close contact against the forming mold, the material is forcedly cooled to Tg or lower and then parted from the forming mold.

4. The process of claim 2, wherein after the material is brought into close contact against the forming mold, the material is forcedly cooled to Tg or lower and then parted from the forming mold.

5. The process of claim 1, wherein the amorphous alloy material capable of showing glass transition is represented by any one of the following general formulas (I) to (III):

General formula (I):

$Al_{100-(a+b)}M^1_zX^1_b$ wherein $M^1$ is at least one element selected from the group consisting of Ti, V, Cr, Mn, Fe, Co, Ni, Cu, Zr, Nb, Mo, Hf, Ta and W; $X^1$ is at least one element selected from the group consisting of Y, La, Ce, Nd, Sm and Gd or Mm (a mischmetal); a and b are 55% or less and 30–90% in terms of atom percent, respectively, and (a+b) is at least 50% in terms of atom percent;

General formula (II):

$X^2_mM^2_nAl_p$ wherein $X^2$ is at least one element selected from the group consisting of Zr and Hf; $M^2$ is at least one element selected from the group consisting of Ni, Cu, Fe, Co and Mn; and m, n and p are 25–85%, 5–70% and 35% or less in terms of atom percent, respectively; and General formula (III):

$Mg_xM^3_yLn_z$ or $Mg_xM^3_yX^2_qLn_z$ wherein $M^3$ is at least one element selected from the group consisting of Cu, Ni, Sn and Zn; $X^2$ is at least one element selected from the group consisting of Al, Si and Ca; Ln is at least one element selected from the group consisting of Y, La, Ce, Nd, Sm and Gd or Mm; and x, y, z and q are 40–90%, 4–35%, 4–25% and 2–25% in terms of atom percent, respectively.

6. The process of claim 1, wherein the heating rate is 10 k/min or greater.

7. The process of claim 1, additionally comprising the step of forcedly cooling the material to a temperature not higher than (Tg−50)K after it has been brought into close contact against the forming mold.

8. The process of claim 1, wherein the amorphous alloy material is a plate having a thickness of 0.5–10 mm.

9. A process for forming an amorphous alloy material capable of showing glass transition, said process comprising the steps of holding the material between frames arranged in combination and holding the material at a temperature between its glass transition temperature (Tg) and its crystallization temperature (Tx) while, at the same time, producing a pressure difference between opposite sides of the material, whereby a forming mold is pressed against the material, the strain rate during forming being from $10^{-5}$ to $10^{2}$/sec and the deformation stress being from 1 MPa to 60 MPa.

10. The process of claim 9, wherein a closed space for a pressurizing fluid is fed to the closed space to bulge out the material in the pressurizing direction, and the forming mold is pressed in a direction opposite to the pressurizing direction against the material 9.

11. The process of claim 9, wherein after the forming mold is pressed against the material to form the latter, the material is forcedly cooled to Tg or lower and then parted from the forming mold.

12. The process of claim 10, wherein after the forming mold is pressed against the material to form the latter, the material is forcedly cooled to Tg or lower and then parted from the forming mold.

13. The process of claim 9, wherein the amorphous alloy material capable of showing glass transition is represented by any one of the following general formulas (I) to (III):

General formula (I):

$Al_{100-(a+b)}M^1_aX^1_b$ wherein $M^1$ is at least one element selected from the group consisting of Ti, V, Cr, Mn, Fe, Co, Ni, Cu, Zr, Nb, Mo, Hf, Ta and W; $X^1$ is at least one element selected from the group consisting of Y, La, Ce, Nd, Sm and Gd or Mm (a mischmetal), a and b are 55% or less and 30–90% in terms of atom percent, respectively; and (a+b) is at least 50% in terms of atom percent;

General formula (II):

$X^2_mM^2_nAl_p$ wherein $X^2$ is at least one element selected from the group consisting of Zr and Hf; $M^2$ is at least one element selected from the group consisting of Ni, Cu, Fe, Co and Mn; and m, n and p are 25–85%, 5–70% and 35% or less in terms of atom percent, respectively; and General formula (III):

$Mg_xM^3_yLn_z$ or $Mg_xM^3_yX^2_qLn_z$ wherein $M^3$ is at least one element selected from the group consisting of Cu, Ni, Sn and Zn; $X^2$ is at lest one element selected from the group consisting of Al, Si and Ca; Ln is at least one element selected from the group consisting of Y, La, Ce, Nd, Sm and Gd or Mm; and x, y, z and q are 40–90,%, 4–35%, 4–25% and 2–25% in terms of atom percent, respectively.

14. The process of claim 9, wherein the heating rate is 10 K/min or greater.

15. The process of claim 9, additionally comprising the step of forcedly cooling the material to a temperature not higher than (Tg−50)K after the forming mold has been pressed against the material.

16. The process of claim 9, wherein the amorphous alloy material is a plate having a thickness of 0.5–10 mm.

* * * * *

UNITED STATES PATENT AND TRADEMARK OFFICE

CERTIFICATE OF CORRECTION

PATENT NO. : 5,324,368

DATED : June 28, 1994

INVENTOR(S) : Tsuyoshi MASUMOTO et al

It is certified that error appears in the above-indentified patent and that said Letters Patent is hereby corrected as shown below:

Column 8, line 68; after "fluid" insert ---is provided on one side of the material, the pressurizing fluid---.

Column 9, line 3; delete "material 9." and insert --material.--

Signed and Sealed this

Sixth Day of December, 1994

*Attest:*

*Attesting Officer*

BRUCE LEHMAN

*Commissioner of Patents and Trademarks*